US007814993B2

(12) United States Patent
White

(10) Patent No.: US 7,814,993 B2
(45) Date of Patent: Oct. 19, 2010

(54) DOWNHOLE POWER GENERATOR AND METHOD

(75) Inventor: Billy W. White, Spring, TX (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 175 days.

(21) Appl. No.: 12/167,003

(22) Filed: Jul. 2, 2008

(65) Prior Publication Data

US 2010/0000793 A1 Jan. 7, 2010

(51) Int. Cl.
*E21B 4/02* (2006.01)
*F03B 13/00* (2006.01)

(52) U.S. Cl. ..... 175/93; 175/96; 175/107; 310/87; 310/75 D; 290/54

(58) Field of Classification Search ..... 175/92–96, 175/101, 104, 107; 415/903; 310/87, 75 R, 310/75 D, 82; 290/54
See application file for complete search history.

(56) References Cited

U.S. PATENT DOCUMENTS

| | | | | |
|---|---|---|---|---|
| 2,944,603 | A | 7/1960 | Baker et al. | |
| 3,036,645 | A | 5/1962 | Rowley | |
| 4,369,373 | A | 1/1983 | Wiseman | |
| 4,415,823 | A | 11/1983 | Jurgens | |
| 4,491,738 | A | 1/1985 | Kamp | |
| 4,654,537 | A | 3/1987 | Gaspard | |
| 4,732,225 | A | 3/1988 | Jurgens et al. | |
| 4,740,711 | A | 4/1988 | Sato et al. | |
| 5,149,984 | A | 9/1992 | Schultz et al. | |
| 5,248,896 | A | 9/1993 | Forrest | |
| 5,517,464 | A | 5/1996 | Lerner et al. | |
| 5,659,205 | A * | 8/1997 | Weisser | 290/52 |
| 5,839,508 | A | 11/1998 | Tubel et al. | |
| 6,011,346 | A | 1/2000 | Buchanan et al. | |
| 6,557,639 | B1 * | 5/2003 | Matthews et al. | 166/369 |
| 6,568,076 | B2 * | 5/2003 | Bottos et al. | 29/888.023 |
| 6,672,409 | B1 | 1/2004 | Dock et al. | |
| 6,739,413 | B2 | 5/2004 | Sharp et al. | |
| 7,002,261 | B2 | 2/2006 | Cousins | |
| 7,025,152 | B2 | 4/2006 | Sharp et al. | |
| 7,133,325 | B2 | 11/2006 | Kotsonis et al. | |
| 2007/0096571 | A1 * | 5/2007 | Yuratich | 310/87 |
| 2008/0246427 | A1 * | 10/2008 | Petit | 318/474 |
| 2009/0169364 | A1 * | 7/2009 | Downton | 415/118 |

* cited by examiner

*Primary Examiner*—David J Bagnell
*Assistant Examiner*—Catherine Loikith
(74) *Attorney, Agent, or Firm*—Browning Bushman P.C.

(57) ABSTRACT

A generator (10) is provided for positioning downhole in a drill string (12) to generate power powering one or more downhole tools (16). The generator includes a progressive cavity housing (28) and a progressive cavity rotor (30) which rotates in response to fluid passing through the progressive cavity housing. A restriction (36) in the annulus downstream from the ports controls the fluid flow in the annulus and past the restriction, and thereby the fluid flow through the progressive cavity housing. The generator may provide either hydraulic or electrical power, or both, powering the one or more tools.

20 Claims, 6 Drawing Sheets

DOWNHOLE POWER GENERATOR AND METHOD

FIELD OF THE INVENTION

The present invention relates to equipment and techniques for generating power downhole in a well, such as an oil and gas well. More particularly, this invention includes a downhole generator assembly with a progressive cavity pump which converts fluid energy into rotational power, which then may be used to generate electrical power or hydraulic power to one or more downhole tools.

BACKGROUND OF THE INVENTION

Various types of downhole power generators have been devised for supplying power to one or more downhole tools, such as sensor tools, measurement-while-drilling (MWD) tools, rotary steerable tools, etc. Many of these downhole generators use fluid power transmitted from the surface to the bottom hole assembly, and commonly rotate a vane within the flow path of the fluid to generate rotary power, which may then be used to generate electrical power. Other devices, such as those disclosed in U.S. Pat. Nos. 6,739,413 and 7,025,152, utilize rotation of a tubular string at the surface to generate downhole power. Those skilled in the art will appreciate that these latter types of systems are not generally favored since rotation of a tubular string may not always be feasible, and may subject the downhole components to high wear.

U.S. Pat. No. 4,415,823 discloses a downhole turbine which drives a generator. U.S. Pat. Nos. 3,036,645 and 2,944,603 also disclose early versions of downhole generators utilizing turbines. U.S. Pat. Nos. 4,369,373, 4,654,537, 4,740,711, 5,149,984, 5,517,464, 5,839,508, 6,672,409, and 7,133,325 also disclose turbine-type devices for generating downhole energy. U.S. Pat. No. 7,002,261 discloses the downhole generation of electrical power utilizing either a turbine or a positive displacement motor, and U.S. Pat. No. 5,248,096 teaches a downhole power generation unit which includes a drilling motor for converting fluid energy into mechanical rotational energy.

U.S. Pat. No. 4,491,738 discloses a technique for generating electrical power downhole with a generator including an anchor which is movable in reciprocating mode in response to pressure pulses in the drilling fluid. U.S. Pat. No. 4,732,225 teaches a downhole motor with a permanent magnet coupling. U.S. Pat. No. 6,011,346 discloses a technique for generating electrical power downhole utilizing piezoelectric members responsive to the flowing stream of fluid.

While various types of downhole generators have been devised, the most popular method of generating power downhole is to use the flowing fluid to rotate a turbine or vane, which then rotates a shaft to drive a generator. Many of these vane-type devices have significant problems due to potential plugging of the device, due to unintentional lost circulation of the fluid, or due to a relatively high rpm but a low torque output. While these vane-type devices have their disadvantages, they also have a significant advantage over other presently available downhole generators, including those which utilize a positive displacement motor. The latter type of prior art devices are believed to suffer from problems associated with articulated joints or universal joints which experience high wear. The bearings on such devices also tend to experience high wear, in part due to the fairly high rpm of the pump in response to fluid flowing through the pump.

The disadvantages of the prior art are overcome by the present invention, and an improved mechanism and technique for generating power downhole is hereinafter disclosed.

SUMMARY OF THE INVENTION

In one embodiment, a generator for positioning downhole in a drill string generates power for powering one or more downhole tools. The generator includes a generally tubular housing for positioning within the drill string, including one or more ports extending radially through the housing. A rotary shaft is also positioned at least partially within the housing. A progressive cavity housing and a progressive cavity rotor are provided, with the rotor rotating in response to fluid passing through the progressive cavity housing to rotate the rotary shaft. A restriction is provided in the annulus downstream from the ports for controlling the fluid flow in the flow annulus and past the restriction, and thereby the fluid flowing through the progressive cavity housing. In one embodiment, the rotary shaft powers a pump to supply hydraulic power to one or more tools. In another embodiment, the rotary shaft rotates one of windings or magnets relative to the other of windings and magnets to generate electrical power for powering one or more tools.

According to one embodiment, a method of generating power downhole for powering one or more tools comprises providing the generally tubular housing, a rotary shaft, and progressive cavity housing as discussed above. The progressive cavity rotor rotates in the progressive cavity housing in response to fluid passing through the progressive cavity housing, thereby rotating the rotary shaft. A restriction is formed in the annulus downstream from the one or more ports for controlling the fluid flow in the flow annulus surrounding the housing and past the restriction, and thereby the fluid flow through the progressive cavity housing.

These and further features and advantages of the present invention will become apparent from the following detailed description, wherein reference is made to the figures in the accompanying drawings.

DETAILED DESCRIPTION OF PREFERRED EMBODIMENTS

Figure 1:
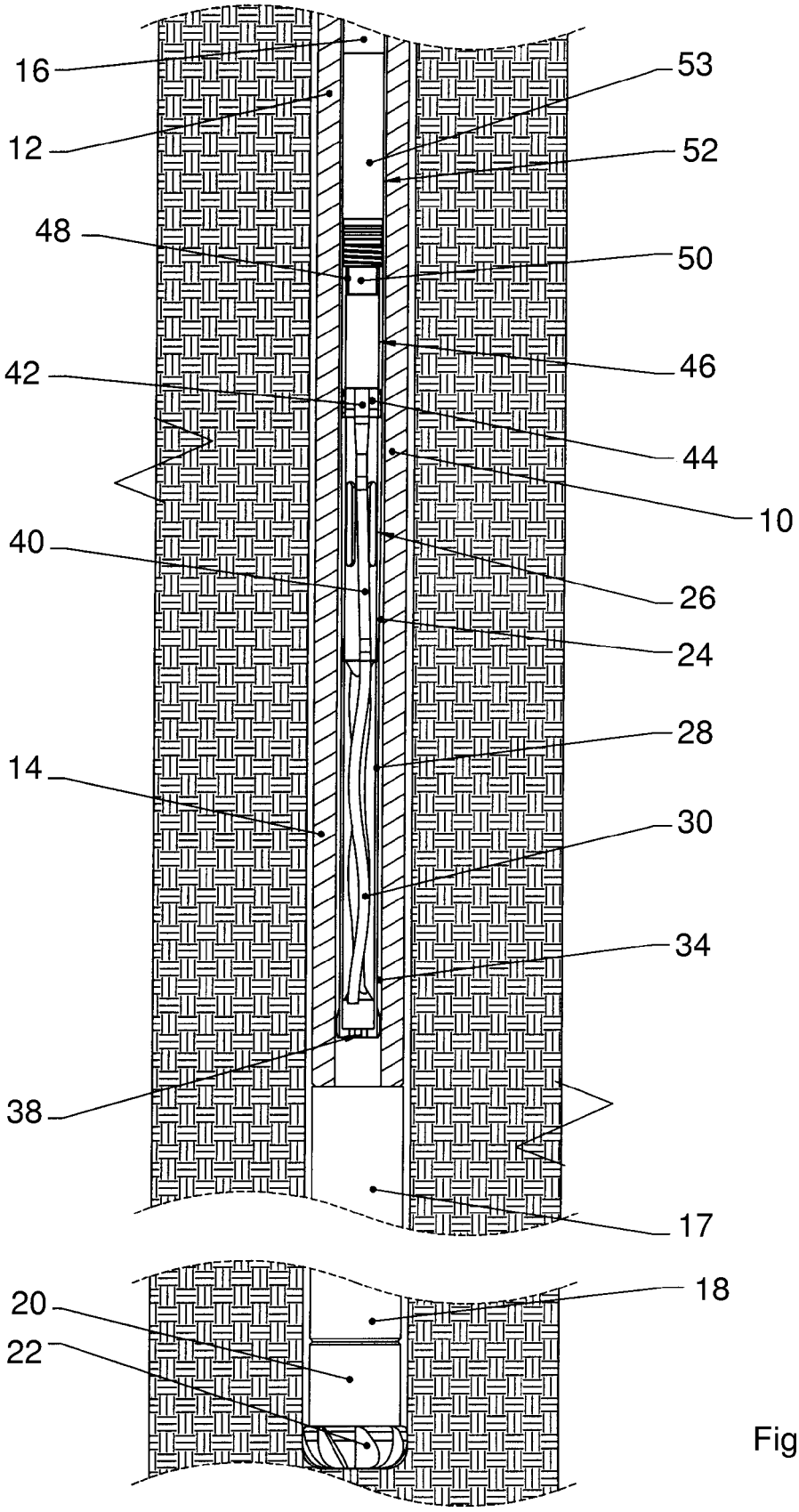
FIG. 1 is a simplified pictorial view of a downhole generator according to the present invention positioned above a positive displacement motor for powering a hydraulic motor to supply pressurized fluid to one or more downhole tools.
Figure 7:
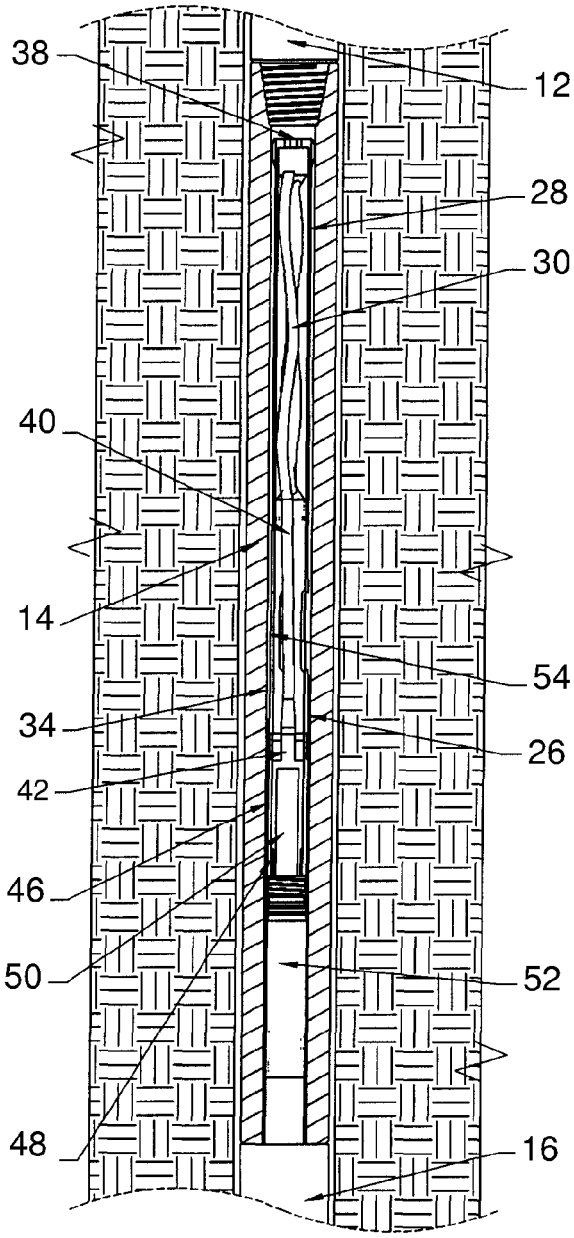
FIG. 7 is an enlarged view of the orifice in the flow restriction.
Figure 7:
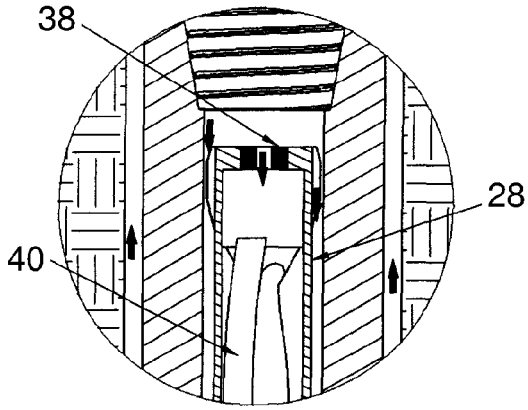
Figure 8:
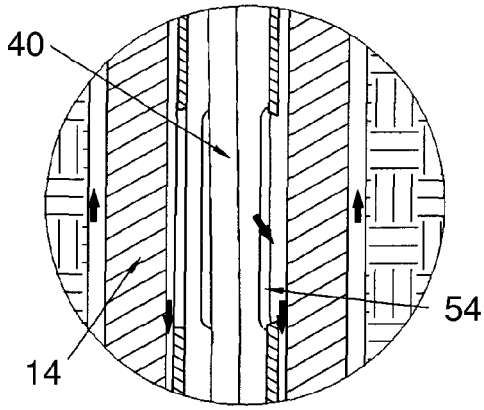
FIG. 8 is an enlarged view of the exhaust ports in the housing.

FIG. 1 depicts one embodiment of a downhole generator 10 for positioning in a well. A generator 10 shown in FIG. 1 is positioned on a tubular string or work string, which includes one or more powered devices 16. The generator and the work string form an annulus between an exterior of the generator or work string and the interior of drill string 12, which may include one or more collars 14 to provide sufficient weight for a downhole drilling operation. FIG. 1 further illustrates bottom hole components 17 and 18 at the lower end of the string, which as discussed subsequently may include a positive displacement motor (PDM) for rotating the bit 22. Bit box 20 may also be rotated by rotating the drill string 12, thereby directly rotating the bit 22.

The generator 10 as shown in FIG. 1 includes a generally tubular housing 24, which as shown in FIG. 1 includes one or more inlet ports 26 extending radially through the housing. A rotary shaft 40, which may be a flexible shaft, is positioned at least partially within the housing 24. The shaft 40 is rotated by the progressive cavity pump, which consists of progressive cavity housing 28 having its bore in fluid communication with the ports 26, and a progressive cavity rotor 30 within the progressive cavity housing and rotating in response to fluid passing through the progressive cavity housing to rotate the shaft 40. An annulus or other radial spacing 34 is provided between an interior of the drill string 12 and an exterior surface of progressive cavity housing, and restriction 36 in the annulus downstream from the ports 26 controls the fluid flow through the annulus and past the restriction, and thereby the fluid flow through the progressive cavity housing.

In a preferring embodiment, the restriction 36 is adjustable, either by changing out the restriction at the surface and by putting in a larger or smaller restriction, or by providing a restriction which is responsive to the energy from the generator to selectively actuate and radially move pads to increase or decrease the flow restriction. Other techniques may be used to vary the effective size of the restriction 36. Another progressive cavity restriction 38 may be provided in fluid communication with the bore through the progressive cavity pump, and further restricts the fluid flow through the progressive cavity housing. The restriction 38 may be a selectively sized orifice.

Fluid flowing downhole in the annulus between the work string and the drill string thus passes through the ports 26 and into the progressive cavity housing 28, thereby rotating the rotor 30. In many embodiments, a substantial portion of the flow downhole to the generator does not pass through the power section formed by housing 28 and rotor 30, but rather flows in the annulus 34 exterior of the progressive cavity housing, past the restriction 36, and then to the bit.

A coupling 46 is provided for transferring the circular motion of the rotor 30 to concentric rotation of the shaft which drives the hydraulic generator 52. FIG. 1 also depicts a bearing 44 for guiding rotation of shaft 42, which is interconnected to coupling 46. Shaft 50 thus rotates with shaft 42, and bearing 48 keeps shaft 50 aligned with a central axis of the tool. Rotation of shaft 50 is coupled to and thus drives the hydraulic generator 52, which preferably is provided in a sealed pressure housing 53. Output from the hydraulic generator 52 may thus be ported to drive any number of desired downhole tools, such as powered device 16. The coupling between shaft 50 and the hydraulic generator 52 may be, but is not restricted to, a magnetic coupling.

Figure 2:
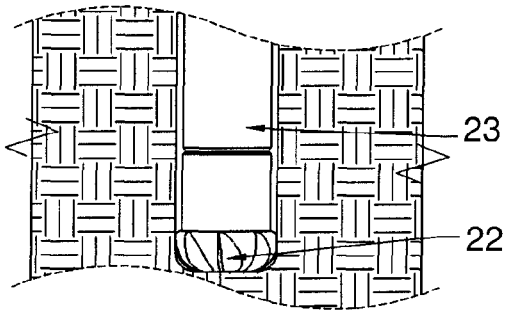
FIG. 2 is an alternate embodiment of a downhole generator wherein a positive displacement motor is provided above the hydraulic motor and a one or more downhole tools.

In the FIG. 2 embodiment, substantially the same structure is used, although the generating tool is inverted since now the progressive cavity housing and rotor are provided above the hydraulic generator 52 and the powered devices or downhole tools 16. In this case, fluid flows down through the center of the work string 12 and some passes through the progressive cavity pump to rotate the shaft 40. Other fluid passes outward of the progressive cavity housing, and through the annulus between that housing and the drill pipe or drill collars. Fluid then flows radially outward through the exhaust ports 54 between the powering pump and into the annulus 34 between the interior of the drill string and an exterior of the housing 26 to mix with the fluid which did not pass through the motor. The progressive cavity housing may thus be positioned above both the tubular housing 26, the hydraulic generator 52, and the one or more powered tools 16.

In the FIG. 2 embodiment, the amount of fluid entering the power section of the power generating PDM may be controlled by orifice 38, which in the FIG. 1 embodiment was provided at the lower end of the tool. A majority of the fluid flow may pass through the annulus between the power section and the tubular outside of the tool. The driven devices 23 are shown below the tool, and as with the other embodiments, could be provided above or below the generating tool. Other bottom hole assembly components 18 may be provided below the generating tool, and if desired may provide directional drilling control to the bit 22.

Figure 3:
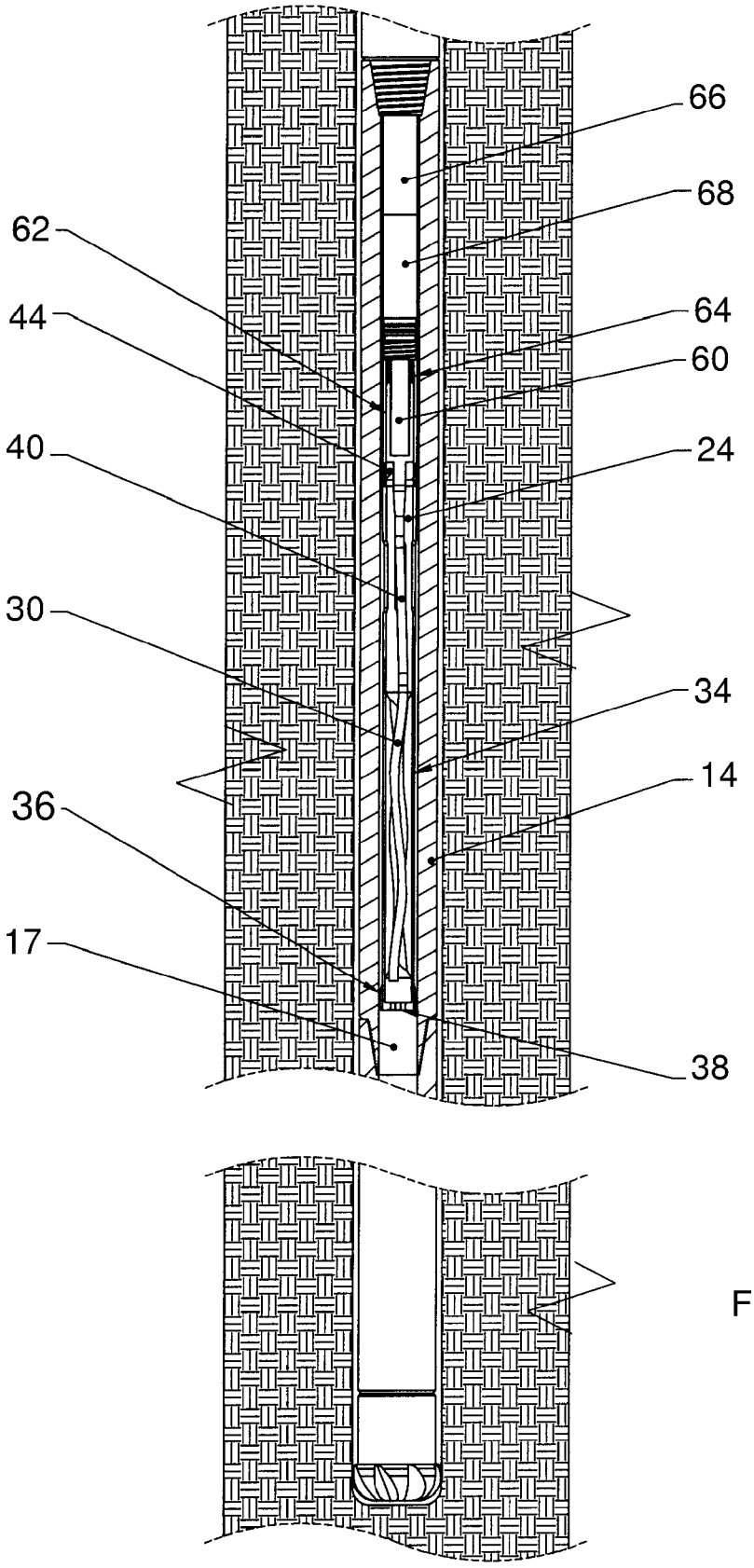
FIG. 3 is a simplified pictorial view of another embodiment wherein the downhole electrical generator is positioned above a positive displacement motor for supplying electrical power to one or more downhole tools.
Figure 4:
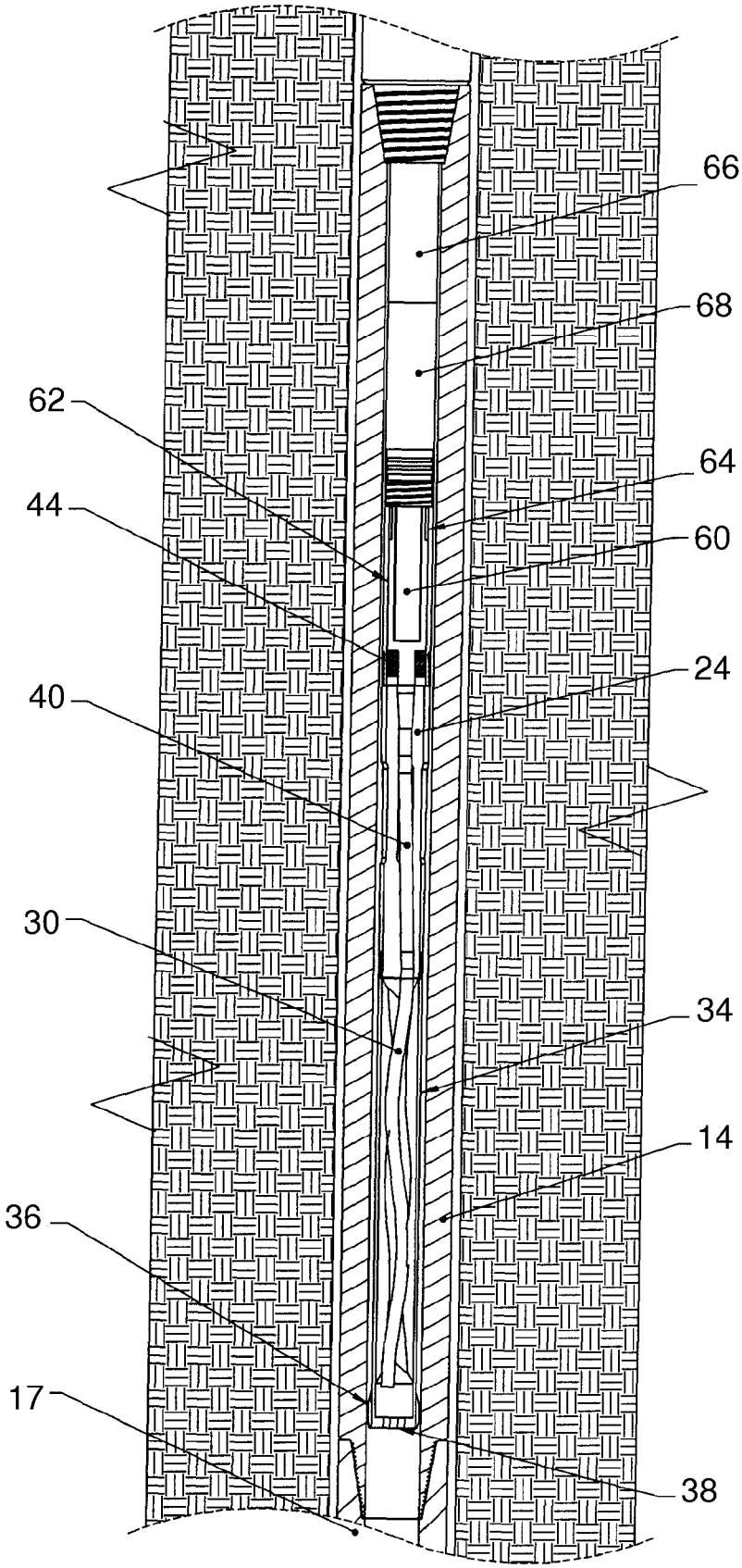
FIG. 4 is an enlarged view of a portion of the embodiment shown in FIG. 3.

Referring now to FIG. 3, a generator 10 is powered by a positive displacement pump including a tubular housing 24 having a one or more inlets therein, and a positive displacement housing 24 below the housing 24 with a progressive cavity rotor 30 in the housing 24 and rotating shaft 40. Movement in the shaft may be guided by thrust bearing 44. A collar 14 may be positioned around the generator tool and the restriction 36, and the orifice 38 may serve the function previously described. Rotation of the shaft 40 rotates the sleeve 62, with a bearing 64 provided at the upper end of the generator. A stem 60 extends downward through the sleeve 62, and the sleeve 62 preferably houses a plurality of magnets circumferentially thereabout, such that the stem 60 positioned within the rotating sleeve 62 generates electrical power which is transmitted to the sealed housing 66 for consumption by electrical devices. The upper end 68 of the generator rotor may thus have a diameter substantially equal to the diameter of the rotating sleeve 62. FIG. 4 more clearly shows the generator and progressive cavity motor shown in FIG. 3. This embodiment thus uses a PDM to generate electrical power, which is then used to control one or more downhole tools, such as a mud pulser tool.

Figure 5:
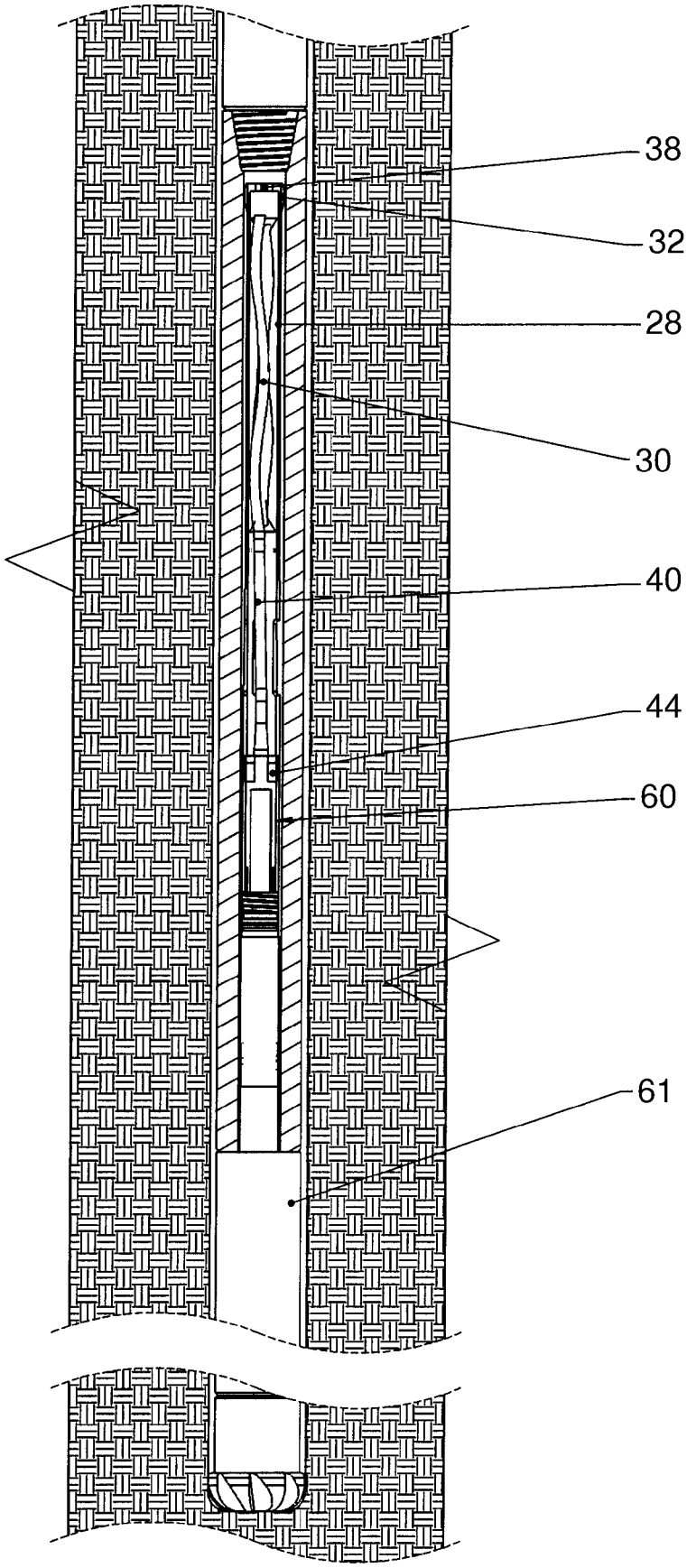
FIG. 5 illustrates a downhole electrical generator for powering one or more downhole tools in combination with a positive displacement motor positioned above the generator.

In the FIG. 3 embodiment, the electrical generator is provided above the progressive cavity housing 24 with the rotor 30 therein. In the FIG. 5 embodiment, another variation of a generator is provided for supplying electrical power to one or more downhole tools 61, although in this case the progressive cavity housing 28 and the rotor are provided above the electrical generator 60. The FIG. 5 embodiment is thus similar in this respect to the FIG. 2 embodiment, except that electrical power rather than hydraulic power is generated. power to one or more downhole tools 61, although in this case the progressive cavity housing 28 and the rotor are provided above the electrical generator 60. The FIG. 5 embodiment is thus similar in this respect to the FIG. 2 embodiment, except that electrical power rather than hydraulic power is generated.

Figure 6:
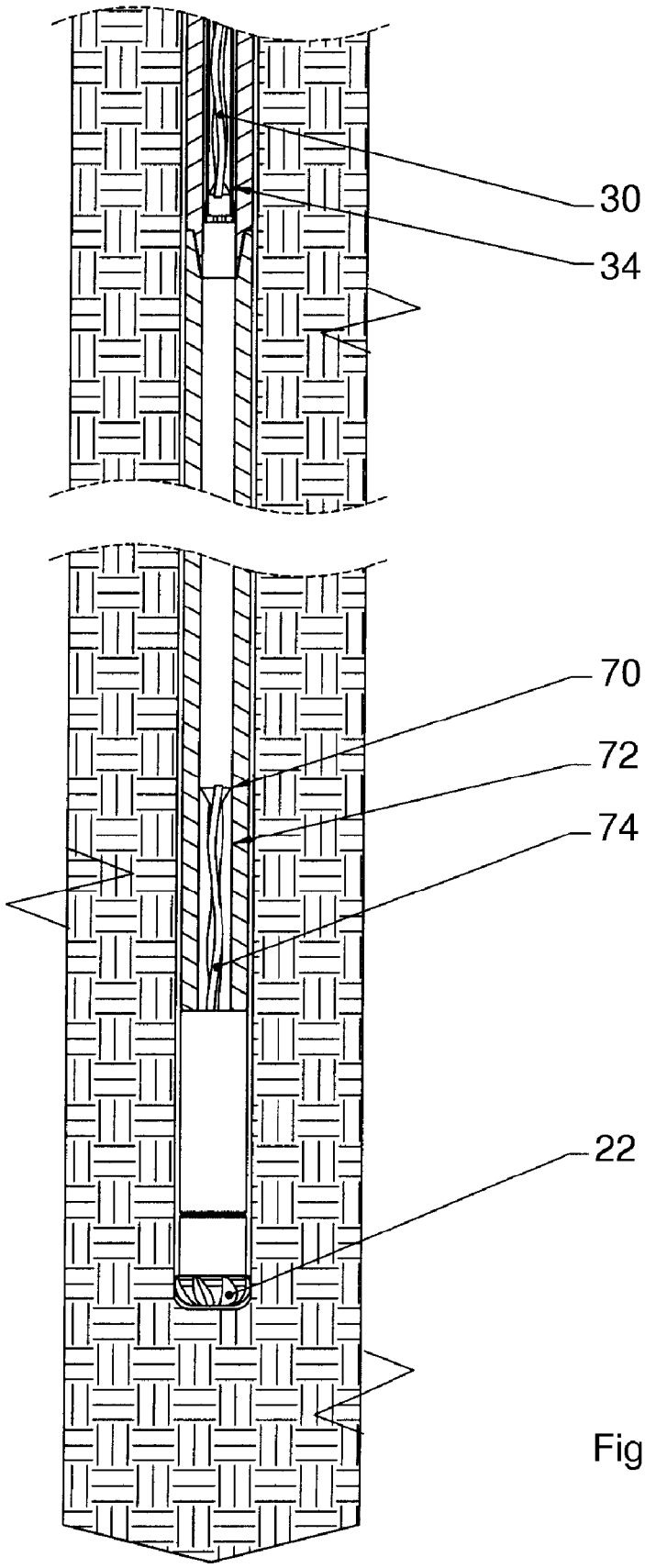
FIG. 6 illustrates a portion of a downhole generator powered by a positive displacement motor with a lower positive displacement motor rotating a drill bit.

In the FIG. 6 embodiment, a lower portion of the housing 24 and the rotor 30 therein is shown, along with another positive displacement motor 70 positioned beneath the motor used to generate power. The upper motor is thus used to power the generator as discussed above, while the lower positive displacement motor 70 and its associated motor housing 72 and rotor 74 are used to power the bit 22. Fluid in the annulus may thus enter the lower motor housing 72 to rotate the rotor and thereby drive the bit in a desired manner. One or more downhole motors for powering downhole tools 61 may be provided below any of the generators disclosed herein. In other embodiments, the bottom hole assembly may include directional drilling tools for steering the bit as it is powered by the electrical generator 60.

One of the advantages of the present invention is that it minimizes the use of U-joints or other articulated joints, which have significant problems when used in many downhole tools. In some applications, a magnetic bearing may be used to reduce friction and minimize wear. The motor used to power the generator preferably is a 1:2 motor, meaning that the motor has the 1 helix rotor and a 2 helix stator enclosing the motor. Motors with more conventional 4:3 or 5:4 assemblies are less preferred, and in many applications will not produce the desired high torque at a reasonable RPM. Using a positive displacement motor as the power generator has significant advantages over vane-type pumps, in that plugging problems associated with vane-type pumps are not common to PDM motors. Also, a downhole assembly as disclosed herein may be used with little concern for lost circulation problems, since significant flow around the powering source occurs even when the generator is supplying electrical power to the downhole tools.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A generator for positioning downhole in a drill string to generate rotary power for powering one or more downhole tools, comprising:

a generally tubular housing for positioning within the drill string and including one or more ports extending radially through the housing;

a rotary shaft positioned at least partially within the housing;

a progressive cavity housing having its bore in fluid communication with the one or more ports, a radial spacing between the drill string and an exterior surface of the progressive cavity housing defining a flow annulus;

a progressive cavity rotor within the progressive cavity housing, the progressive cavity rotor rotating in response to fluid passing through the progressive cavity housing to rotate the rotary shaft; and a restriction in the annulus downstream from the one or more ports for controlling the fluid flow in the flow annulus and past the restriction, and thereby the fluid flow through the progressive cavity housing.

2. A generator as defined in claim 1, wherein the restriction in the annulus is adjustable to vary the fluid flow.

3. A generator as defined in claim 1, further comprising:

a progressive cavity restriction in fluid communication with the bore of the progressive cavity housing, the progressive cavity restriction further restricting the fluid flow through the progressive cavity housing.

4. A generator as defined in claim 1, further comprising:

a flexible shaft interconnecting the progressive cavity rotor and the rotary shaft.

5. A generator as defined in claim 1, wherein the rotary shaft rotates one of winding and magnets with respect to the other of windings and magnets to generate electric power for powering the one or more tools.

6. A generator as defined in claim 1, wherein the rotary shaft powers a pump to supply hydraulic power to the one or more tools.

7. A generator as defined in claim 1, wherein the progressive cavity housing is positioned above both the tubular housing and the one or more downhole tools.

8. A generator for positioning downhole in a drill string to generate power for powering one or more downhole tools, comprising:

a generally tubular housing for positioning within a drill string and including one or more ports extending radially through the housing;

a rotary shaft positioned at least partially within the housing;

a progressive cavity housing having its bore in fluid communication with the one or more ports, a radial spacing between the drill string and an exterior surface of the progressive cavity housing defining a flow annulus;

a progressive cavity rotor within the progressive cavity housing, the progressive cavity rotor rotating in response to fluid passing through the progressive cavity housing, and thereby rotating a connecting shaft extending between the rotary shaft and the progressive cavity rotor; and a restriction in the annulus downstream from the one or more ports for controlling the fluid flow in the flow annulus and past the restriction, and thereby the fluid flow through the progressive cavity housing.

9. A generator as defined in claim 8, wherein the restriction is adjustable to vary the fluid flow in the annulus past the restriction.

10. A generator as defined in claim 8, further comprising:

a progressive cavity restriction in fluid communication with the bore of the progressive cavity pump, the progressive cavity restriction further restricting the fluid flow through the progressive cavity housing.

11. A generator as defined in claim 8, wherein the progressive cavity rotor has one lobe, and the bore in the progressive cavity housing has two circumferentially spaced lobes.

12. A generator as defined in claim 8, further comprising:

a positive displacement motor below the progressive cavity housing, the motor including a progressive cavity rotor powered by fluid passing by the restriction, the motor powering a rotatable drill bit.

13. A generator as defined in claim 8, further comprising:

a return annulus radially outward of the tubular housing for returning to the surface fluids pumped past the restriction or through the progressive cavity housing.

14. A method of generating power downhole for powering one or more downhole tools, comprising:

providing a generally tubular housing for positioning within the drill string and including one or more ports extending radially through the housing;

providing a rotary shaft at least partially within the housing;

providing a bore in a progressive cavity housing in fluid communication with the one or more ports, a radial spacing between the drill string and an exterior surface of the progressive cavity housing defining a flow annulus;

providing a progressive cavity rotor within the progressive cavity housing, the progressive cavity rotor rotating in response to fluid passing through the progressive cavity housing, and thereby rotating the rotary shaft; and forming a restriction in the annulus downstream from the one or more ports for controlling the fluid flow in the flow annulus surrounding the housing and past the restriction, and thereby the fluid flow through the progressive cavity housing.

15. A method as described in claim 14, further comprising:

selectively varying the restriction to vary the flow rate past the restriction.

16. A method as described in claim 14, further comprising:

providing a progressive cavity restriction in fluid communication with the bore of the progressive cavity housing, the progressive cavity restriction further restricting the fluid flow through the progressive cavity housing.

17. A method as described in claim 14, wherein the progressive cavity rotor has one lobe, the bore in the progressive cavity housing has two circumferentially spaced lobes.

18. A method as defined in claim 14, wherein fluid pumped past the restriction or through the progressive cavity housing are returned to the surface through a return annulus radially outward of the tubular housing.

19. A method as defined in claim 14, wherein the rotary shaft rotates one of winding and magnets with respect to the other of windings and magnets to generate electric power for powering the one or more tools.

20. A method as defined in claim 14, wherein the rotary shaft powers a pump to supply hydraulic power to the one or more tools.

* * * * *